US008075427B2

(12) United States Patent
Millsap

(10) Patent No.: US 8,075,427 B2
(45) Date of Patent: Dec. 13, 2011

(54) VOLLEYBALL INSTRUCTIONAL APPARATUS

(76) Inventor: Colleen Millsap, Sterling, VA (US)

( * ) Notice: Subject to any disclaimer, the term of this patent is extended or adjusted under 35 U.S.C. 154(b) by 0 days.

(21) Appl. No.: 12/458,187

(22) Filed: Jul. 2, 2009

(65) Prior Publication Data

US 2010/0009785 A1 Jan. 14, 2010

Related U.S. Application Data

(60) Provisional application No. 61/129,662, filed on Jul. 10, 2008.

(51) Int. Cl.
*A63B 69/00* (2006.01)

(52) U.S. Cl. ..... 473/464; 473/422

(58) Field of Classification Search ..... 473/422, 473/459, 464, 473; 2/158–160, 161.1, 161.2, 2/16, 17, 20

See application file for complete search history.

(56) References Cited

U.S. PATENT DOCUMENTS

| | | | | | |
|---|---|---|---|---|---|
| 2,710,409 | A | * | 6/1955 | Burandt | 2/160 |
| 3,725,957 | A | * | 4/1973 | Shotmeyer | 2/161.1 |
| 4,587,673 | A | | 5/1986 | Boliard | |
| 4,665,565 | A | * | 5/1987 | Odom | 2/161.2 |
| D290,304 | S | * | 6/1987 | Fink | D2/617 |
| 4,795,163 | A | | 1/1989 | Szabo | |
| 5,165,696 | A | | 11/1992 | Saha | |
| 5,460,385 | A | | 10/1995 | Lazzeroni | |
| 5,918,318 | A | * | 7/1999 | Jones | 2/239 |
| 6,006,358 | A | * | 12/1999 | Keating | 2/161.1 |
| 6,279,164 | B1 | | 8/2001 | Martin | |
| 6,338,163 | B1 | * | 1/2002 | Markson | 2/163 |
| 6,964,063 | B2 | | 11/2005 | Bamber | |
| 7,058,984 | B2 | | 6/2006 | Newman | |
| 7,337,474 | B1 | | 3/2008 | Godson | |
| 2003/0131393 | A1 | * | 7/2003 | Votolato | 2/16 |
| 2003/0190984 | A1 | | 10/2003 | Selburg | |
| 2004/0172735 | A1 | * | 9/2004 | Garland | 2/160 |
| 2010/0009785 | A1 | * | 1/2010 | Millsap | 473/464 |

* cited by examiner

*Primary Examiner* — Raleigh W. Chiu
(74) *Attorney, Agent, or Firm* — Jones Day

(57) ABSTRACT

The present invention is directed to a volleyball instructional apparatus and methods of using such apparatus, more particularly to a volleyball instructional apparatus that provides assistance with training a user how to establish proper hand, forearm, and/or body positioning when bumping or striking a volleyball during different volleyball motions. The instructional apparatus comprises a first hand member, a second hand member and an element for maintaining said first and second hand members.

17 Claims, 6 Drawing Sheets

VOLLEYBALL INSTRUCTIONAL APPARATUS

CROSS REFERENCE TO RELATED APPLICATION

This application claims the benefit of priority from U.S. Provisional Application No. 61/129,662, filed Jul. 10, 2008, which is further incorporated herein by reference.

FIELD OF THE INVENTION

The present invention is directed to a volleyball instructional apparatus and methods of using such apparatus, more particularly to a volleyball instructional apparatus that provides assistance with training a user how to establish proper hand, forearm, and/or body positioning when bumping or striking a volleyball during different volleyball motions, for example, a forearm pass.

BACKGROUND OF THE INVENTION

A difficult and time consuming skill to learn in the sport of volleyball is the proper hand, forearm, and/or body position to a forearm bump, forearm pass, or serve-receive. A frequent problem when learning volleyball motions such as the forearm bump pass, includes, but is not limited to, poor positioning of a user's hand(s), forearm(s), and/or body. A purpose of the present invention is to provide an apparatus to teach the proper hand, forearm, and/or body positioning to a user.

SUMMARY OF THE INVENTION

In one aspect, the present invention provides a volleyball instructional apparatus that has a first hand member and second hand member.

In another aspect, the present invention provides an apparatus that has first and second hand members, each having an opening in it for receiving the first and second hands, or a portion thereof, respectively, of a user, and having a top and bottom surface.

In another aspect, the present invention provides an apparatus that has first and second hand members with an opening for receiving the hands, or portions thereof, and a top and bottom surface; and an element, e.g., hook-and-loop fastener, stitching, staple, buckle, snap, lace, adhesive, and other bonding or contacting material, for maintaining, e.g., securely, detachably, fixedly, permanently, rotatably, and extensively, the first and second hand members, preferably a portion of the top surface of the first hand member abuts directly or indirectly a portion of the bottom surface of the second hand member.

In another aspect of the present invention, the first and second hand members are maintained, where a majority portion of the top surface of the first hand member abuts directly or indirectly a majority portion of the bottom surface of the second hand member.

In another aspect of the present invention, the first and second hand members are maintained, where a substantial portion of the top surface of the first hand member abuts directly or indirectly a substantial portion of the bottom surface of the second hand member.

In another aspect, the present invention provides an apparatus that has first and second hand members, each having an opening in it for receiving the first and second hands, or a portion thereof, respectively, of a user, and each having a top and bottom surface; and each hand member further comprising a finger region and a palm region with top and bottom surfaces.

In another aspect, the present invention provides an apparatus that has first and second hand members with an opening in each for receiving the hands, or portions thereof, and top and bottom surfaces, along with a finger region and palm region, and an element for maintaining the first and second hand members, preferably where the bottom surface of the palm region of the first hand does not contact the bottom surface of the palm region of the second hand.

In another aspect, the present invention provides an apparatus that has first and second hand members with an opening in each for receiving the hands, or portions thereof, and top and bottom surfaces, along with a finger region and palm region, and an element for maintaining the first and second hand members, preferably where the bottom surface of the palm region of the first hand does not substantially contact the bottom surface of the palm region of the second hand.

In another aspect, the present invention provides a volleyball instructional apparatus that has hand members, for example gloves, mitts, cuffs, sleeves, into which a user can insert its first and second hands, respectively.

In another aspect, the present invention provides a volleyball instructional apparatus capable of assisting the thumb alignment of a user.

In another aspect, the present invention provides a volleyball instructional apparatus that has a thumb guide, for example a thumb pocket or thumb marking, suitable to assist proper thumb alignment.

In one aspect, the present invention provides for a thumb alignment where a portion of the interior edge of the thumb on the first hand is in side-by-side contact with a portion of the interior edge of the thumb on the second hand.

In another aspect, the present invention provides for a thumb alignment where portions of the interior edges of the thumbs between (and including) the distal knuckle and the proximal end of the nail are in side-by-side contact.

In another aspect, the present invention provides for a thumb alignment where portions of the inferior edges of the thumbs are either not in side-by-side contact at all or substantially not in side-by-side contact. In another aspect, the present invention provides for a thumb alignment where the thumbs are spaced apart In a further aspect, the present invention provides a volleyball instructional apparatus capable of assisting the user with establishing a flat platform for bumping or striking the volleyball.

In another aspect, the present invention provides an elbow or forearm member to establish this desired outcome.

In another aspect, the present invention provides a volleyball instructional apparatus capable of assisting the user with not swinging its arms when bumping or striking a volleyball.

In another aspect, the present invention provides an ankle member to establish this desired outcome.

In another aspect, the present invention provides a dampening member.

In another aspect, the present invention provides methods of using an apparatus where a user inserts a first hand into a first hand member, inserts a second hand into a second hand member and maintains the first and second hand members so that a portion of the top surface of the first hand member abuts directly or indirectly a portion of the bottom surface of the second hand member.

DETAILED DESCRIPTION OF THE INVENTION

Figure 1:
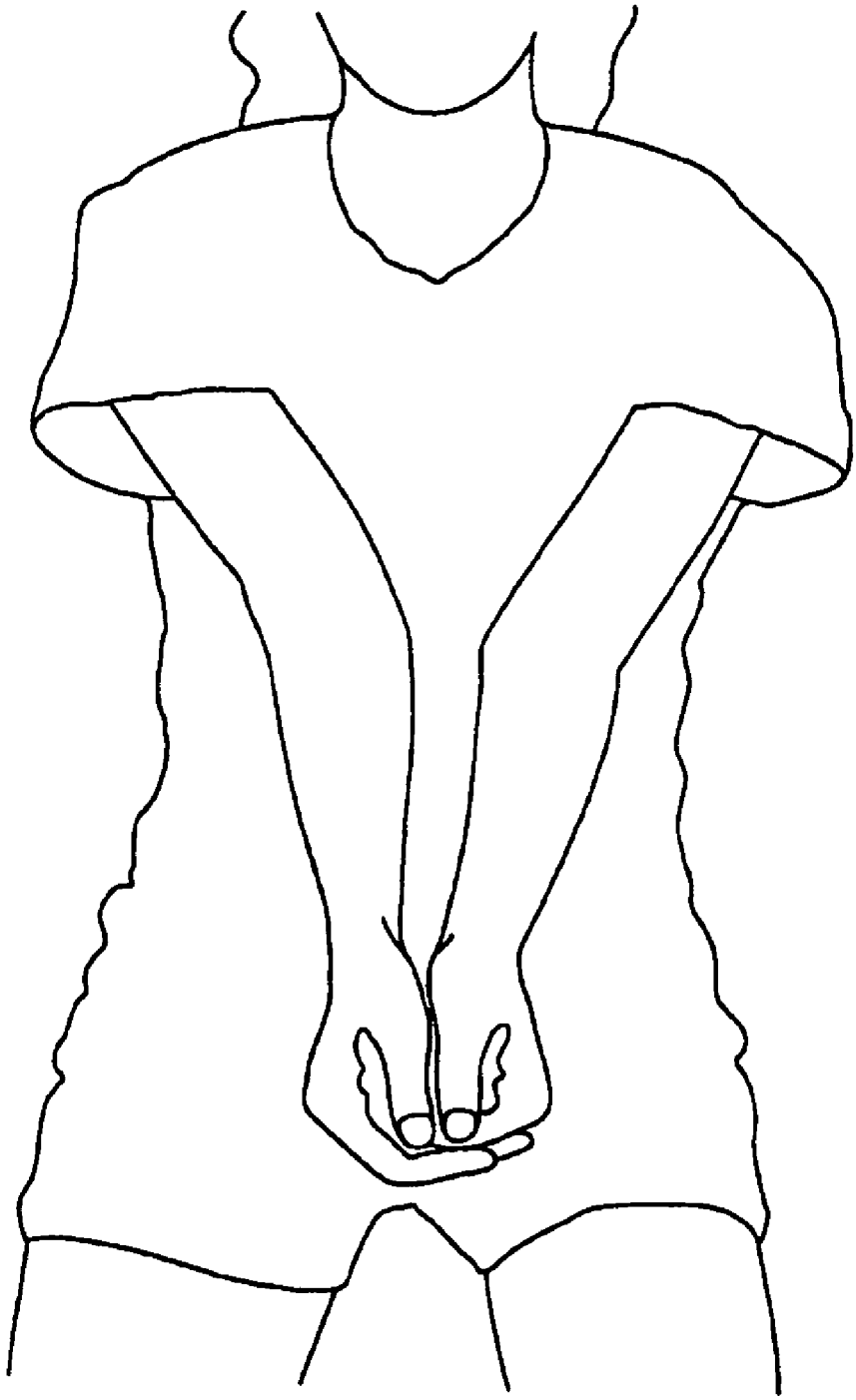
FIG. 1 illustrates a user having a cupped-palm position with proper thumb alignment.

The present invention is directed toward a volleyball instructional apparatus that may be used with either the cupped palms (also called cupped hands) or wrapped first hands (also called first wrap) positions. Specifically, the present invention comprises a volleyball instructional apparatus having a first and second hand member designed to receive the hands of a user and bring them together. The present invention may further comprise a volleyball instructional apparatus having an elbow member that is capable of aiding the user to straighten or flatten its forearms. Furthermore, the present invention may comprise a volleyball instructional apparatus having an ankle member designed to attach the hand member(s) to a portion of the lower body so a user is prevented from over-swinging. Optionally, the present invention may additionally comprise a thumb guide that allows a user to position its thumbs in the proper alignment. Also, the present invention may comprise a dampening member that strikes the ball when the ball is struck outside of the proper region for hitting, e.g., forearms, causing the force of the ball to be dampened or the direction of the ball to be misguided.

The volleyball instructional apparatus of the present invention is useful for teaching the proper hand and/or elbow position for volleyball motions, for example, forearm bump passing.

Furthermore, the volleyball instructional apparatus of the present invention is designed to establish, after training with it, a higher precision and/or greater accuracy of ball placement, and overall better performance of properly striking a volleyball, or any combination thereof, compared to known techniques or other volleyball instructional apparatus.

Referring to the drawings, FIGS. 1-4 illustrate a user having a cupped-palm position. The present invention may be modified and designed according to a wrapped first hand position.

Hand Member

Suitable hand members comprise a glove, glove-like, mitt, mitt-like, cuff, sleeve, or loop. Each member has a top and bottom surface and a proximal (closer to the body of the user) and distal end (farther from the body of the user). Furthermore, each member has an opening for receiving a user's hand.

Figure 2:
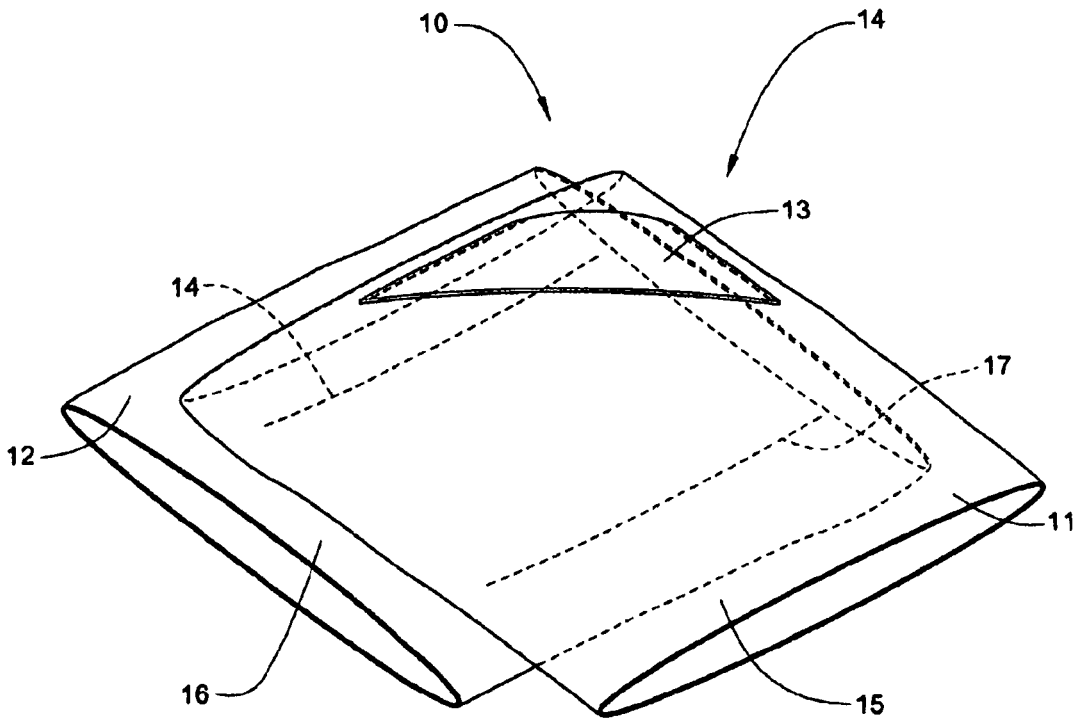
FIG. 2 illustrates a top-view of a volleyball instructional apparatus.

FIG. 2 shows a volleyball instructional apparatus 10 as used for a cupped palm position which includes a first hand member 11 and a second hand member 12. Although FIGS. 2-4 provide illustrations having the right hand 18 as the first hand and the left hand 19 as the second hand, it should be understood the present invention covers apparatuses for users whose left hand is the first hand and the right hand is the second hand.

Figure 3:
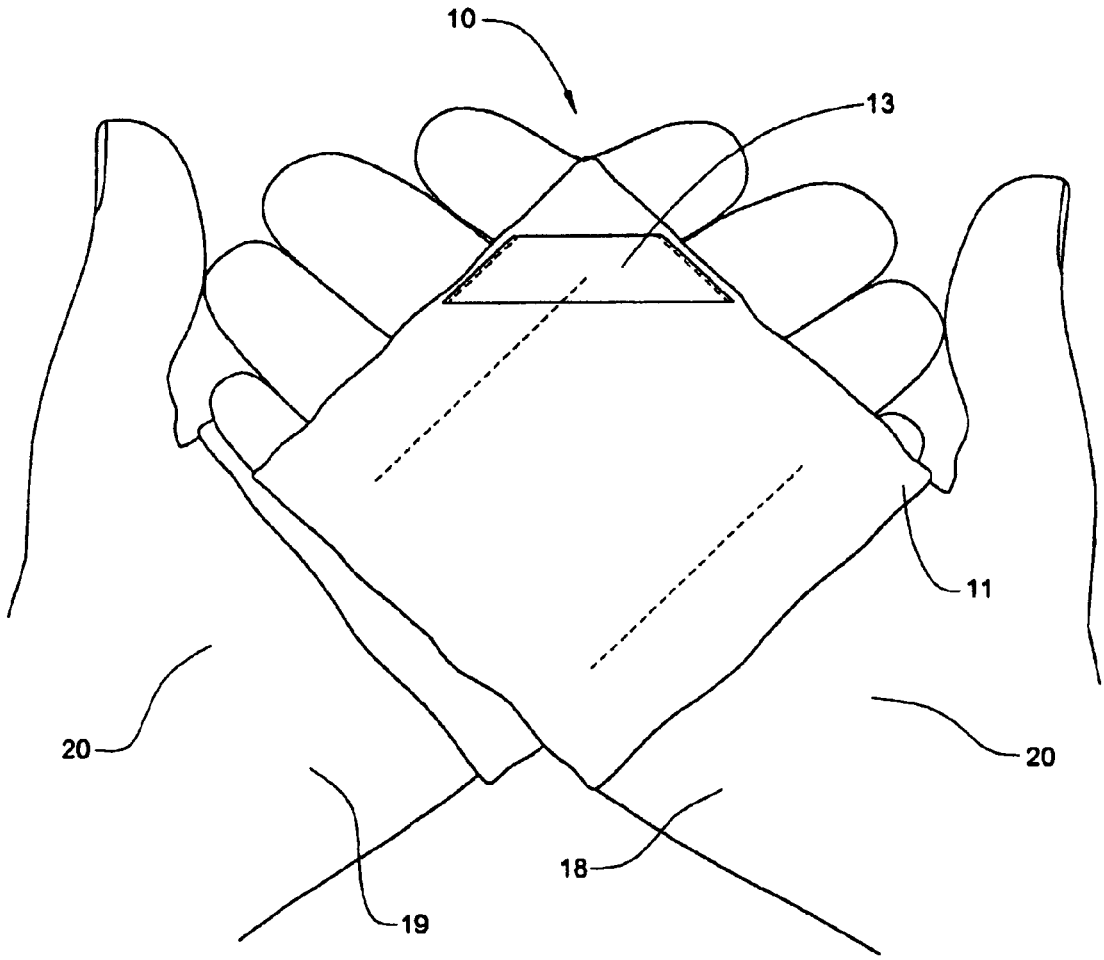
FIG. 3 illustrates a top-view of a volleyball instructional apparatus having a first and second hand inserted into such volleyball instructional apparatus with the palms facing up
Figure 4:
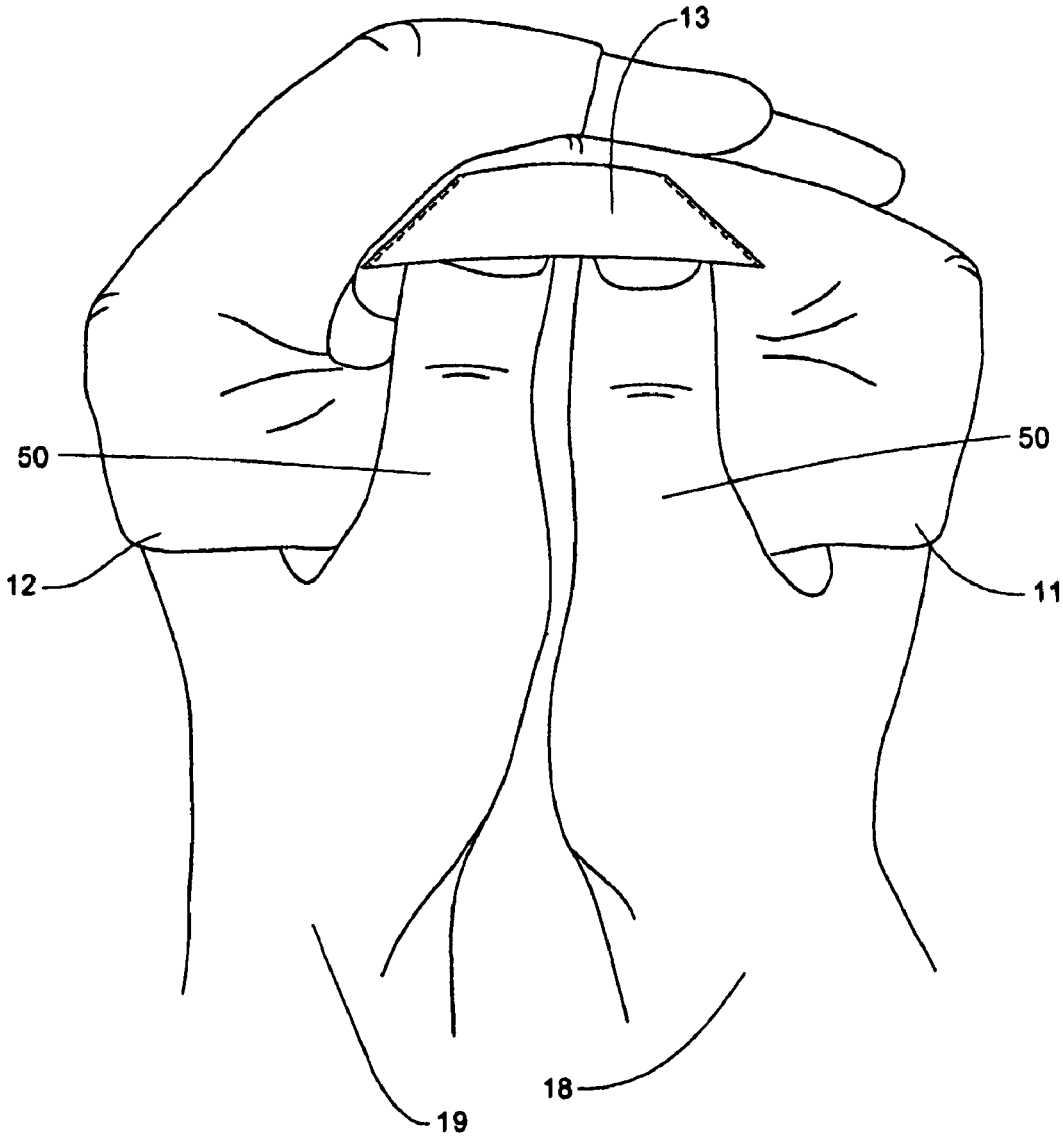
FIG. 4 illustrates a top-view of a volleyball instructional apparatus having a first and second hand inserted into a volleyball instructional apparatus with the hands folded inward and thumbs placed into a thumb pocket.

In addition to the opening in the hand member for receiving a user's hand, the hand member may have an opening 14 at the distal end of the member, allowing a portion of or all of the user's fingers to protrude from the respective segment, as shown in FIG. 3. A hand member may be configured like a glove and have an individual sleeve for each finger or portion thereof, e.g., an index or forefinger portion, a second or middle finger portion, a ring finger or third finger portion, a little finger or fourth finger portion, and a thumb or portion thereof, for receiving a user's fingers or portions thereof. Alternatively, a hand member may have a sleeve for groups of fingers, e.g., first and second fingers together and third and fourth fingers together, or any combination thereof of fingers. A hand member may also comprise a wrist portion and/or a palm portion.

A hand member may also comprise of a finger region and/or palm region having a top and bottom surface. Likewise, a hand or portion thereof that is inserted into a hand member may comprise a finger region and/or a palm region having a top and bottom surface.

In one embodiment, a hand member may comprise a sleeve which covers all or substantially all the wrist, and optionally portions of the forearm. Furthermore, a hand member may be padded, non-padded, or substantially padded at any portion of the member.

A hand member may include ways for adjusting the size of the hand member around the user's hands, For example, a hand member may comprise a string, strap, Velcro™ (hook-and-loop fastener). The hand member is adjusted to satisfy the convenience of each user.

Alternatively, a hand member may be designed and/or adjusted to allow a user to insert, and remove, its hand without difficulty into a hand member, allowing a user to have a hand, e.g., first hand, second hand, both, eligible for other volleyball motions, e.g., a one-arm dig.

A hand member may be formed of neoprene, leather, cloth, nylon, rubber, plastic, canvas, Lycra™ (spandex/elastane), Spandex™ (spandex), tarp, or other flexible elastic material. A hand member may include decorative pictures or graphics or materials and/or text on the surface of either or both hand members, as well as decorations intermixed with the material used for making each or both hand members. A hand member may comprise apertures or vents making it breathable to air and moisture.

The first hand member 11 and the second hand member 12 may be maintained by an element, for example, Velcro™ (hook-and-loop fastener), stitching, staples, buckles, snaps, laces, adhesive or other bonding material. The first 11 and second hand members 12 may be maintained in various ways, including, but not limited to, securely, detachably, fixedly, permanently, rotatably, and extensively. FIG. 2 shows the first hand member 11 at least securely connected to the second hand member 12 by stitching 17. Stitching 17 or other known methods for securely connecting the first and second hand members may be oriented in any direction.

The members may be maintained together on either bottom or top surface, preferably on the top surface 15 of the first hand member 11 and the bottom surface 16 of the second hand member 12. In some embodiments, the top surface of the first hand member and bottom surface of the second hand member are maintained to form an integral unit or a set. In other embodiments, the top surface of the first hand member and bottom surface of the second hand member are maintained to form a releasable unit allowing for separation of the first and second hand members, for example, by Velcro™ (hook-and-loop fastener).

In some embodiments, a portion of the top surface of the first hand member abuts directly or indirectly a portion of the bottom surface of the second hand member. Alternatively, a majority portion of top surface of the first hand member abuts directly or indirectly a majority portion of the bottom surface of the second hand member. In other embodiments, a substantial portion of top surface of the first hand member abuts directly or indirectly a substantial portion of the bottom surface of the second hand member.

In some embodiments, the top surface of the finger region of the first hand abuts directly, i.e., contacts, or abuts indirectly, i.e., does not contact but overlaps, the bottom surface of the finger region of the second hand. In some embodiments, a portion of the top surface of the finger region of the first hand abuts directly or indirectly a portion of the bottom surface of the finger region of the second hand. In other embodiments, a majority portion of the top surface of the finger region of the first hand abuts directly or indirectly a majority portion of the bottom surface of the finger region of the second hand. In other embodiments, a substantial portion of the top surface of the finger region of the first hand abuts directly or indirectly a substantial portion of the bottom surface of the finger region of the second hand. In another embodiment, the bottom surface of the finger region of the first hand does not contact the bottom surface of the finger region of the second hand.

In some embodiments, the bottom surface of the palm region of the first hand does not contact the bottom surface of the palm region of the second hand. In other embodiments, the bottom surface of the palm region of the first hand does not substantially contact the bottom surface of the palm region of the second hand. In other embodiments, the bottom surface of the palm region of the first hand contacts less than, for example, 50%, 40%, 25%, preferably less than 20%, 10% of the bottom surface of the palm region of the second hand.

Elbow Member

Suitable elbow members are used to teach the user the proper forearm positioning to create a flat platform for bumping or striking the volleyball.

In some embodiments, an elbow member 72 is a first or second elbow member that comprises a sleeve or cuff covering all or substantially all the elbow, and optionally the forearm or a portion thereof, and optionally the wrist or a portion thereof. In other embodiments, an elbow member may include a plastic or metal brace to prevent one or more elbows from bending an undesired amount.

An elbow member may be formed of neoprene, leather, cloth, nylon, rubber, plastic, canvas, Lycra™ (spandex/elastane), Spandex™ (spandex), tarp, or other flexible elastic material. The elbow member may further comprise metal or other material to keep the elbows from bending. It may include decorative pictures or graphics or materials and/or text on the surface of either or both forearm members, as well as decorations intermixed with the material used for making each or both elbow members.

An elbow member may include ways for adjusting the size of the member around the user's elbows and/or forearms. For example, an elbow member may comprise a string, strap, Velcro™ (hook-and-loop fastener), and plastic gauge (similar to the type found on a baseball cap). Such elbow member may comprise of apertures or vents making it breathable to air and moisture.

The first elbow member and the second elbow member may be maintained by any known methods for maintaining two members, for example, Velcro™ (hook-and-loop fastener), stitching, staples, buckles, snaps, laces, adhesive or other bonding material. The first and second elbow members may be maintained on the interior surface of the respective elbow members. Alternatively, the elbow members may be maintained by any method to allow for a flatter forearm platform.

In other embodiments, an elbow member is a device as described in U.S. Pat. No. 4,795,163 to Szabo, which is incorporated by reference in its entirety. Briefly, this device comprises an armrest securely connected to a bent shaft which is securely connected to a hand-grasp. This device may be integral or comprise more than one piece. Furthermore, the hand grasp is moveable along the bent shaft to accommodate users with different arm lengths. A further improvement of this elbow member is the use of cast material for the armrest during its manufacture, so that it fits comfortably the specific user.

Ankle Member

Suitable ankle members are used to teach the user from developing bad habits such as swinging the arms when bumping or striking a volleyball.

In some embodiments, an ankle member 74 is a cord having the top end securely connected to the back of a hand member, preferably the second hand member, and the bottom end securely connected to the user at a location below the hands, for example the waist, upper leg(s), knee(s), lower leg(s), preferably the ankle(s) or part of the foot (feet) such as the heel(s). A cord may be formed from surgical tubing or surgical cord material or any other similar material that may be used to create the proper elasticity to prevent swinging of the arms, especially excessive swinging.

The end of the cord which is connected to the back of the second hand member may be connected by any known methods, for example, Velcro™ (hook-and-loop fastener), stitching, staples, hook and loop fasteners, buckles, snaps, laces, adhesive or other bonding material. The other end of the cord which is connected to the user may also be connected by any known methods, for example, Velcro™ (hook-and-loop fastener), buckles, string, snaps, or laces.

Thumb Guide

In addition to the components mentioned above, the present invention may also include a thumb guide used to assist the user with proper thumb alignment.

Suitable thumb guides include a thumb pocket 13 and thumb markings. FIGS. 2-4 illustrate a thumb pocket.

A thumb pocket 13 may be made of the same material as the hand member. A thumb pocket 13 may comprise one compartment used for both thumbs or a split compartment which the user inserts each the respective thumb. Also, a thumb pocket may comprise a loop(s) used to hold the thumb (s). Further, a thumb pocket 13 may optionally include a string, strap, sliding mechanism, Velcro™ (hook-and-loop fastener), gauge to adjust the size of the pocket around the user's hand.

The location of the thumb pocket 13 may be on the top surface of either hand member, preferably the top surface of the first hand member. Furthermore, a thumb pocket may be located at the distal portion, preferably on the top surface, of a hand member or anywhere on the surface of the hand member that allows for a user to place its thumbs.

A thumb pocket may also have an opening at the distal end of the pocket to allow protrusion of a portion of the thumb or the thumb pocket may be closed.

The instructional apparatus may optionally comprise thumb markings on the top surface of the hand member to aid in thumb alignment. These markings may be raised above the top surface of one or both hand members or may be otherwise indicated thereon.

Figure 5:
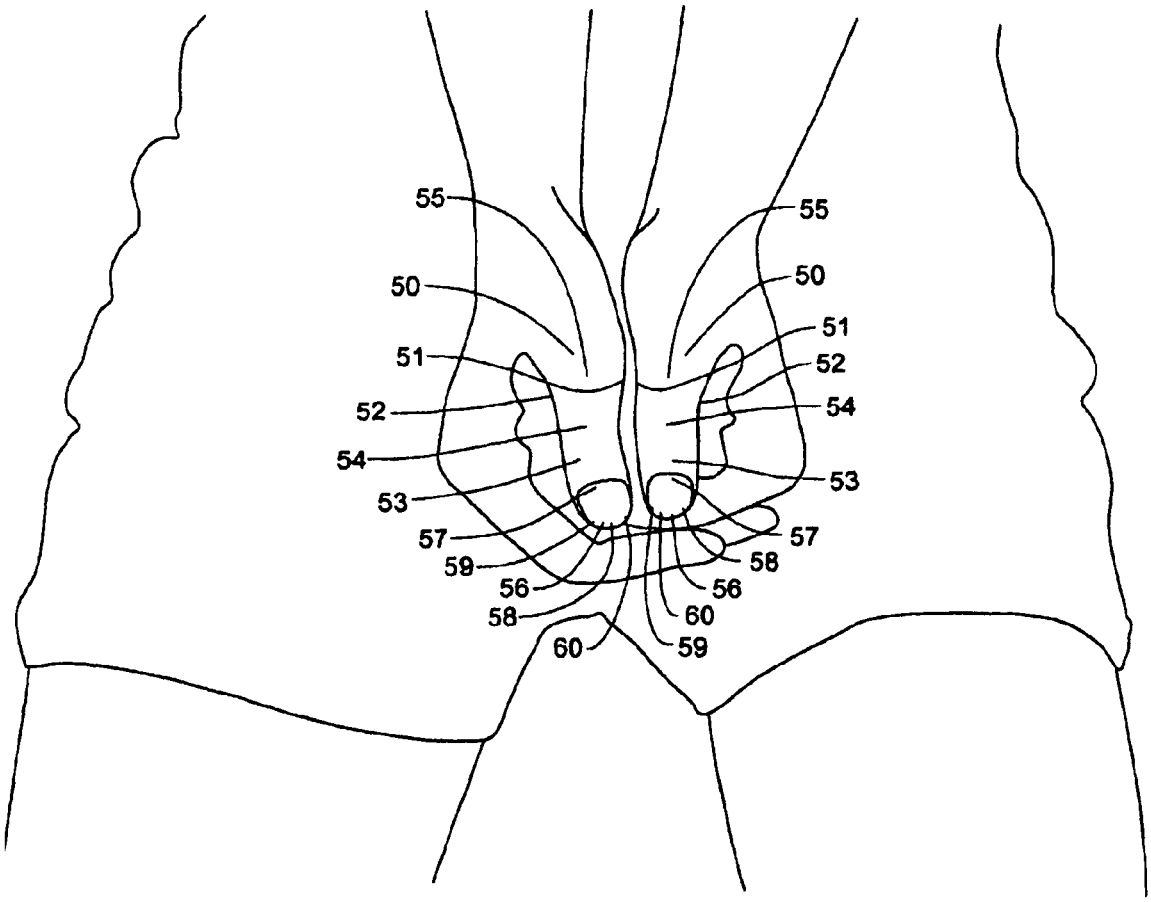
FIG. 5 illustrates an example of a user having proper thumb alignment.
Figure 6:
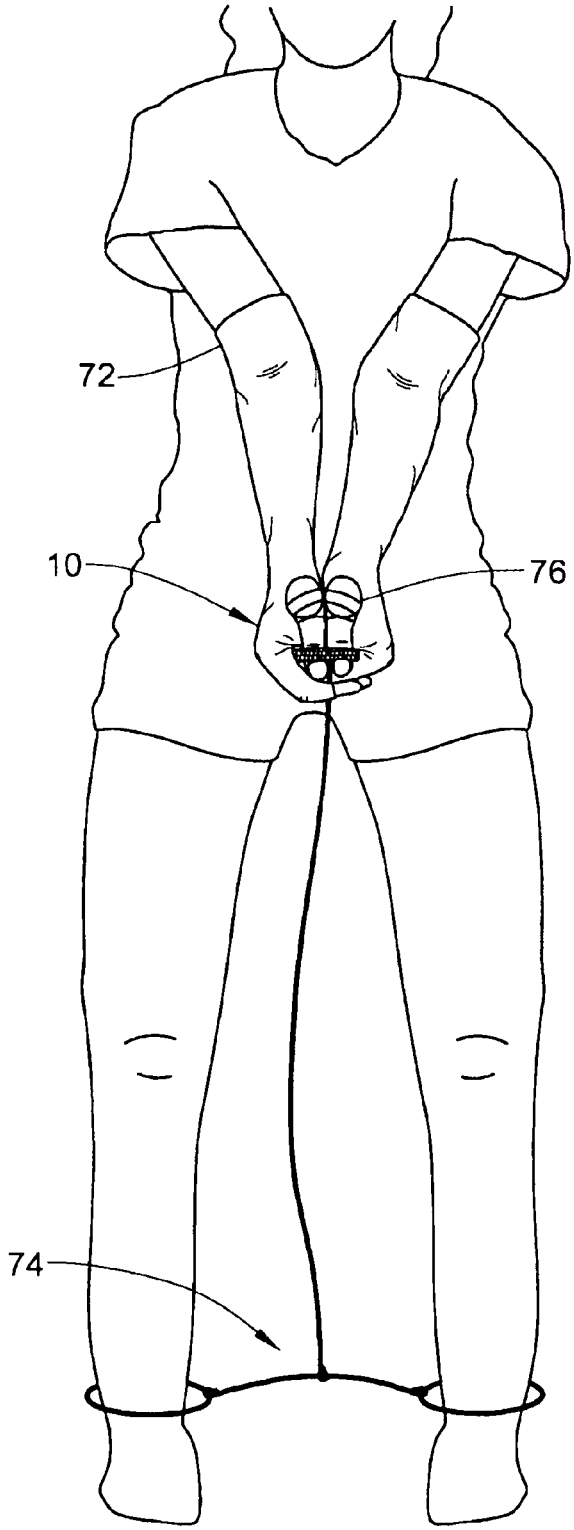
FIG. 6 illustrates a volleyball instructional apparatus having an elbow member, an ankle member and a misdirection dampening member.

FIG. 5 shows an example of a user having proper thumb alignment. Each thumb 50 of a user comprises four edges, i.e., an interior edge 51, exterior edge 52, inferior edge (not shown) and superior edge 53. Furthermore, each thumb comprises a distal knuckle 54 (farther away from the body) and a proximal knuckle 55 (closer to the body). Each thumb also comprises a nail 56 having a proximal end 57 and distal end 58. Additionally, each thumb comprises a semicircle arch 59 at the distal end 60 of the thumb.

A proper thumb alignment is established when the thumbs 50 of the user are parallel or substantially parallel with the interior edges 51 of the thumbs 50 side-by-side and thumbs 50 pointing away from the body and slightly down. A proper thumb alignment may be established with or without the use of a thumb guide.

In some embodiments, the interior edge 51 of the thumb 50 on the first hand is in side-by-side contact with the interior edge 51 of the thumb 50 on the second hand, for example contact greater than 25%, 30%, 40%, 50%, 60%, 70%, 80%, and 90%.

In other embodiments, the interior edges 51 of the thumbs 50 between (and including) the distal knuckle 54 and the proximal end of the nail 57 are in side-by-side contact, for example contact greater than 50%, 60%, 70%, preferably greater than 75%, 80%, 85%, 90%, 95%, 96%, 97%, 98%, and 99%.

In other embodiments, the interior edges 51 of the thumbs 50 between (and including) the distal knuckle 54 and the distal end 60 of the thumb (excluding the semicircle arch 59) are in side-by-side contact, for example contact greater than 50%, 60%, 70%, preferably greater than 75%, 80%, 85%, 90%, 95%, 96%, 97%, 98%, and 99%.

In other embodiments, the inferior edges 51 of the thumbs 50 are in side-by-side contact, for example, less than 50%, 45%, 40%, 35%, 30%, 25%, 20%, preferably less than 15%, 10%, 5%, 4%, 3%, 2% and 1%.

In other embodiments, a space or gap greater than 0.5 mm, for example, greater than 1 mm, 2 mm, 3 mm, 4 mm, 5 mm, 10 mm, 15 mm, or 20 mm, exists between the inferior edges 51 of the thumbs 50 in a proper thumb alignment.

Dampening Member

In addition to the above components, the present invention can include a dampening member used to lessen the bumping or striking force, or to misdirect the volleyball if improperly bumped or struck with the hands or hand member(s) instead of the platform created by the forearms. A dampening member 76 may include, but is not limited to, a spherically-shaped object made of either a hard or soft material suitable for the intended use of such member, i.e., dampening and/or misdirection. A dampening member may be located anywhere on a hand member, for example, the top surface of one or both hand members, preferably between the user's thumbs.

Use

The present invention may comprise hand member(s), elbow member(s), ankle member(s), thumb guide(s), and/or dampening member(s), or any combination thereof.

In some embodiments, the volleyball instructional apparatus may comprise a hand member. In some embodiments, the volleyball instructional apparatus may comprise a hand member with a thumb guide. In other embodiments, the volleyball instructional apparatus may comprise a hand member with a thumb guide and a dampening member. In some embodiments, the volleyball instructional apparatus may comprise a hand member (with or without a thumb guide and/or a dampening member) and an elbow member. In other embodiments, the volleyball instructional apparatus may comprise a hand member (with or without a thumb guide and/or a dampening member), an elbow member and an ankle member.

The user of the present invention may be of all levels and sizes of athletes and non-athletes. The present invention may be used for practice, recreation, and/or competition, preferably practice.

In some embodiments, a user inserts its first hand 18 with the palm 20 facing up into first hand member 11 and its second hand 19 with the palm 20 facing up into the second hand member 12. The user folds its hands 18 and 19 inward until the thumbs 50 of the first and second hands are properly aligned, pointing away from the body and slightly down.

In other embodiments, a user employs the thumb guide, for example the thumb pocket 13 or thumb markings, and practices in a conventional manner.

In some embodiments, a user inserts its second hand 19 into the second hand member 12 and securely connects the hand member 12 to the second hand 19 and repeats the same for the first hand 18 and the first hand member 11.

In other embodiments, a user does not securely connect one of its hands, preferably the first hand, with its respective hand member thereby allowing a user to remove one hand, preferably the first hand, from its respective hand member, by simply withdrawing the hand away from the hand member to allow for use during additional volleyball motions which require the user's hands to be separate, e.g., one-arm dig.

In other embodiments, a user places its elbows into an elbow member in addition to inserting its hands into respective hand members.

In other embodiments, a user connects one end of a cord to a hand member, preferably the second hand member, and the other end of the cord to the ankle, in addition to inserting its hand into respective hand members, and proceeds to practice a proper bumping technique, for example, not swinging the arms.

Tests used to compare the results between training with the present invention and other training techniques or other instructional apparatuses are performed by one or more users, e.g., a panel of users. Such tests may include, but are not limited to, selecting a target location and measuring a percentage of balls hit within and/or near the target or cumulative distance from a target. Tests may also include measuring a percentage of balls clustered together after striking the volleyball. Tests may further include one or more judges who evaluate based on a set of criteria, e.g., accuracy, precision, ball flight, striking mechanics, and/or the overall performance of a user.

For example, a user before training with the instructional apparatus of the present invention may strike or bump the volleyball a set number times intending to reach the selected target location in order to establish a score. Subsequently, the same user trains with the instructional apparatus of the present invention by practicing for a duration of time, e.g., one minute, five minutes, 10 minutes, 20 minutes, 30 minutes, one hour, two hours, five hours, one day, two days, three days, four days, five days, six days, seven days, two weeks, one month, two months, six months, one year, and more than one year. Then, the user performs a post-training test and strikes or bumps the volleyball a set number of times, for example the same number of times as in the pre-training rest, intending to reach the selected target location, for example the same target location in the pre-training rest, and establishes a score, which is compared, using, for example, a percentage calculation, to the pre-training score.

In another example, the same user after establishing a pre-training score subsequently trains with an instructional apparatus or training technique not according to the present invention, establishes a score, and compares it with the post-training score obtained with the apparatus and/or methods of the present invention.

The present invention yields a higher precision and/or greater accuracy of ball placement, and overall better performance of properly striking a volleyball, or any combination thereof, compared to either training techniques, e.g., previous training received by a user as well as additional training techniques, or other volleyball instructional apparatus.

In some embodiments, the present invention improves precision by more than 5%, for example, 10%, 15%, 20%, 25%, preferably, more than 30%, 40%, 50% and 75%. In some embodiments, the present invention improves accuracy by more than 5%, for example, 10%, 15%, 20%, 25%, preferably, more than 30%, 40%, 50% and 75%. In other embodiments, the present invention improves overall performance of properly striking a volleyball, providing superior results.

All publications and patent applications mentioned in this specification are herein incorporated by reference in their entirety to the same extent as if each individual publication or patent application was specifically and individually indicated to be incorporated by reference herein in its entirety.

While preferred embodiments of the present invention have been shown and described herein, it will be obvious to those skilled in the art that such embodiments are provided by way of example only. Numerous variations, changes and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents are covered thereby.

What is claimed is:

1. An apparatus comprising:

(a) a first hand member having an opening for receiving at least a portion of a first hand and having a top and bottom surface, (b) a second hand member having an opening for receiving at least a portion of a second hand and having a top and bottom surface; and (c) an element for fixedly attaching a portion of said top surface of said first hand member to a portion of said bottom surface of said second hand member; and (d) a thumb guide for receiving two thumbs positioned proximate the upper surface of said second hand member for guiding a first and second thumb.

2. An apparatus according to claim 1, wherein said element fixedly attaches a pre-determined portion of said top surface of said first hand member to a pre-determined portion of said bottom surface of said second hand member.

3. An apparatus according to claim 1, wherein said element is a hook-and-loop fastener stitching, staple, buckle, snap, lace, adhesive and other bonding or contacting material.

4. An apparatus according to claim 1, wherein said hand members are selected from a group consisting of a glove, glove-like, mitt, mitt-like, cuff, sleeve, and loop.

5. An apparatus according to claim 1, wherein said hand members comprise neoprene, leather, cloth, nylon, rubber, plastic, canvas, tarp, spandex/elastane, spandex, or tarp.

6. An apparatus according to claim 1, further comprising a thumb guide positioned proximate the upper surface of said second hand member.

7. An apparatus according to claim 6, wherein said thumb guide is a thumb pocket.

8. An apparatus according to claim 6, wherein said thumb guide comprises one or more loops.

9. An apparatus according to claim 1, further comprising at least one misdirection element proximate the opening in said second hand member.

10. An apparatus according to claim 1, further comprising an elbow member associated with and/or attached to the first and/or second hand members.

11. An apparatus according to claim 10, wherein said elbow member comprises a first and second elbow member.

12. An apparatus according to claim 10, wherein said elbow member is a device comprising an armrest, shaft and hand grasp.

13. An apparatus according to claim 1, further comprising an ankle member connected to a portion of said first and/or second hand members.

14. An apparatus according to claim 13, wherein said ankle member is a cord.

15. An apparatus according to claim 14, wherein a top end of said cord is securely connected to said bottom surface of the second hand member and a bottom end of said cord is securely connected to an ankle of a user.

16. An apparatus according to claim 1, wherein at least one of said first or second hand members comprise at least one additional opening, opposite said opening, for allowing at least the fingertips portion of said hand to pass through.

17. An apparatus comprising:

(a) a first hand member having a first opening for receiving at least a portion of a first hand, an opposing second opening for exposing at least a portion of the fingers, and a top and bottom surface, (b) a second hand member having a first opening for receiving at least a portion of a second hand, an opposing second opening for exposing at least a portion of the fingers, and a top and bottom surface; and (c) an element for maintaining a portion of said top surface of said first hand member associated either directly or indirectly with a portion of said bottom surface of said second hand member; and (d) a thumb guide comprising one or more loops attached to the upper surface of said second hand member.

* * * * *